US011293439B2

(12) United States Patent
Lee et al.

(10) Patent No.: US 11,293,439 B2
(45) Date of Patent: Apr. 5, 2022

(54) COMPRESSOR

(71) Applicant: LG ELECTRONICS INC., Seoul (KR)

(72) Inventors: Seungmock Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 54 days.

(21) Appl. No.: 16/600,023

(22) Filed: Oct. 11, 2019

(65) Prior Publication Data

US 2020/0116149 A1 Apr. 16, 2020

(30) Foreign Application Priority Data

Oct. 12, 2018 (KR) ..... 10-2018-0121656

(51) Int. Cl.
*F04C 29/02* (2006.01)
*F04C 18/02* (2006.01)
*F04C 29/06* (2006.01)

(52) U.S. Cl.
CPC ..... *F04C 29/026* (2013.01); *F04C 18/0207* (2013.01); *F04C 29/065* (2013.01); *F04C 2240/30* (2013.01); *F04C 2240/60* (2013.01)

(58) Field of Classification Search
CPC .... F04C 23/008; F04C 23/02; F04C 18/0215; F04C 29/045; F04C 2240/807; F04C 29/026; F04C 29/065; F04C 29/068; F04C 18/0207; F04C 2240/805; F04B 39/04
USPC ..... 417/312, 423.7, 902
See application file for complete search history.

(56) References Cited

U.S. PATENT DOCUMENTS 5,037,278 A * 8/1991 Fujio ..... F04C 18/0215 418/55.2
5,040,952 A 8/1991 Inoue et al.
7,384,250 B2 * 6/2008 Shin ..... F04C 18/0215 184/6.18

(Continued)

FOREIGN PATENT DOCUMENTS

JP S57018491 1/1982
JP 08028476 1/1996

(Continued)

OTHER PUBLICATIONS

Extended European Search Report in European Application No. 19202780.3, dated Nov. 29, 2019, 7 pages.

*Primary Examiner* — Patrick Hamo
*Assistant Examiner* — Wesley G Harris
(74) *Attorney, Agent, or Firm* — Fish & Richardson P.C.

(57) ABSTRACT

A compressor includes: a case including a discharge part configured to discharge refrigerant and defining a reservoir space configured to store oil; a drive unit including a stator and a rotor; a rotary shaft coupled to the rotor; a compression unit coupled to the rotary shaft and lubricated with oil, the compression unit being configured to compress refrigerant and discharge compressed refrigerant in a direction away from the discharge part; a muffler coupled to the compression unit and configured to guide refrigerant to the discharge part; a separator coupled to at least one of the rotor or the rotary shaft and configured to separate oil from refrigerant guided to the discharge part; and a coupling unit that fixes the separator to the at least one of the rotor or the rotary shaft.

11 Claims, 11 Drawing Sheets

(56) References Cited

U.S. PATENT DOCUMENTS

| | | | | |
|---|---|---|---|---|
| 8,801,397 | B2 * | 8/2014 | Okaichi | F04C 29/023 417/366 |
| 2009/0293534 | A1 * | 12/2009 | Tanaka | F04C 23/008 62/470 |
| 2012/0269667 | A1 | 10/2012 | Sakima et al. | |
| 2012/0297818 | A1 * | 11/2012 | Toyama | F04B 39/023 62/470 |
| 2017/0089624 | A1 | 3/2017 | Yokoyama et al. | |

FOREIGN PATENT DOCUMENTS

| | | |
|---|---|---|
| JP | 2007205270 | 8/2007 |
| KR | 100575815 | 5/2006 |

* cited by examiner

COMPRESSOR

CROSS-REFERENCE TO RELATED APPLICATIONS

This application claims the benefit of Korean Patent Application No. 10-2018-0121656, filed on Oct. 12, 2018, which is hereby incorporated by reference as if fully set forth herein.

BACKGROUND OF THE INVENTION

Field of the Invention

The present disclosure relates to a compressor, and more particularly to a scroll compressor in which a separator for separating refrigerant and oil from each other is firmly coupled to a drive unit providing power needed to compress the refrigerant, so that the scroll compressor can compensate for an eccentric moment of the drive unit.

Discussion of the Related Art

Generally, a compressor is an apparatus for use in a refrigerating cycle (hereinafter referred to as a refrigeration cycle), for example, a refrigerator or an air conditioner. The compressor is an apparatus that provides a work or task required to generate heat exchange in the refrigeration cycle by compressing refrigerant.

The compressor may be classified into a reciprocating compressor, a rotary compressor, a scroll compressor, etc. according to a method for compressing the refrigerant. The scroll compressor is a compressor in which an orbiting scroll performs an orbiting motion by engaging with a fixed scroll fixed into an inner space of a hermetic container such that a compression chamber is formed between a fixed wrap of the fixed scroll and an orbiting wrap of the orbiting scroll.

The scroll compressor may obtain a relatively higher compression ratio because fluid can be continuously compressed through scroll shapes engaged with each other as compared to other types of compressors, and has advantages in that suction, compression, and discharge cycles of refrigerant are smoothly performed to obtain a stable torque. For this reason, the scroll compressor has been widely used for refrigerant compression in an air conditioner or the like.

A conventional scroll compressor may include a case forming an outer appearance thereof and having a discharge part through which refrigerant is discharged, a compression part fixed into the case to compress the refrigerant, and a drive unit fixed into the case to drive the compression part. The compression part and the drive unit may be coupled to each other through a rotary shaft that rotates by coupling to the drive unit.

The compression unit may include a fixed scroll and an orbiting scroll. The fixed scroll is fixed into the case and includes a fixed wrap. The orbiting scroll includes an orbiting wrap that is driven by engaging with the fixed wrap through the rotary shaft. In the conventional scroll compressor, the rotary shaft is eccentrically provided therein, and the orbiting scroll is fixed into the eccentric rotary shaft and rotates with the eccentric rotary shaft. Thus, the orbiting scroll may compress the refrigerant while revolving (or orbiting) along the fixed scroll.

Generally, the conventional scroll compressor includes a compression unit provided at a lower part of the discharge part and a drive unit provided at a lower part of the compression unit. One end of the rotary shaft may be coupled to the compression unit, and the other end of the rotary shaft may pass through the drive unit.

The conventional scroll compressor has disadvantages in that the compression unit is provided above the drive unit and is located closer to the discharge part so that it is difficult to supply oil to the compression unit and a lower frame is additionally required to separately support the rotary shaft connected to the compression unit at a lower part of the drive unit. In addition, the conventional scroll compressor has other disadvantages in that gas force generated by the refrigerant in the compressor is different in action point from reaction force supporting the gas force so that scroll tilting may unavoidably occur, resulting in reduction in efficiency and reliability of the compressor.

In order to address the above-mentioned issues, an improved scroll compressor (also called a lower scroll compressor) in which a drive unit is provided at a lower part of the discharge part and a compression unit is located at a lower part of the drive unit has recently been developed.

In the lower scroll compressor, the discharge part is located closer to the drive unit than the compression unit, and the compression unit is located farthest from the discharge part.

The lower scroll compressor has advantages in that one end of the rotary shaft is connected to the drive unit and the other end of the rotary shaft is supported by the compression unit in a manner that a lower frame can be omitted such that oil stored in a lower part of the case can be directly supplied to the compression unit without passing through the drive unit. In addition, in the event that the rotary shaft of the lower scroll compressor is connected to the compression unit while passing through the compression unit, an action point of gas force and an action point of reaction force are identical to each other on the rotary shaft, so that vibrations of the scrolls or overturning moments of the scrolls are offset against each other, resulting in guarantee of efficiency and reliability in the lower scroll compressor.

On the other hand, the lower scroll compressor may rotate in an eccentric state of the rotary shaft, and may enable the orbiting scroll to revolve around the eccentric rotary shaft, so that eccentric moments or bending moments may occur whenever the rotary shaft rotates. Therefore, the lower scroll compressor further includes a balancer to offset (or cancel) vibrations or bending moments caused by eccentricity of the rotary shaft. The balancer is provided to any one of the drive unit and the rotary shaft so as to compensate for eccentricity of the rotary shaft.

In addition, whereas the lower scroll compressor can smoothly supply oil to the compression unit, the lower scroll compressor may enable the oil and the compressed refrigerant to intermingle, so that the intermingled resultant refrigerant with the oil may be discharged to the discharge part. As a result, since the oil is discharged from the compressor, compression efficiency of the compressor may be reduced and reliability of the compressor may also be deteriorated.

To this end, the discharge part includes a separator that is coupled to the drive unit to centrifugally separate oil from the compressed refrigerant. The separator rotates with the drive unit so that high-density oil can be centrifugally separated from the refrigerant by the separator.

However, the conventional lower scroll compressor has disadvantages in that, when a rotation speed of the drive unit is changed or the drive unit first rotates at a high speed and then suddenly decelerates, the separator is unavoidably separated from the drive unit. As a result, the separator separated from the drive unit may collide with the case or may damage the drive unit, resulting in reduction in reliability of the lower scroll compressor.

The separator and the balancer are coupled to or installed in the drive unit at different positions, so that the inner space of the case is unavoidably narrowed. Furthermore, the region of the drive unit is limited in size, so that it is difficult for both the balancer and the separator to be installed in the conventional lower scroll compressor.

The conventional lower scroll compressor has to prevent both the balancer and the separator from being separated from the drive unit, resulting in greater user inconvenience.

In addition, the conventional lower scroll compressor has other advantages in that oil centrifugally separated from the separator remains in the separator without being collected in a reservoir space.

SUMMARY OF THE INVENTION

Accordingly, the present disclosure is directed to a compressor that substantially obviates one or more problems due to limitations and disadvantages of the related art.

An object of the present disclosure is to provide a scroll compressor for enabling a separator that separates refrigerant and oil from each other to always be kept in a fixed state in the compressor in any situation.

Another object of the present disclosure is to provide a scroll compressor capable of maintaining coupling force between a drive unit supplying power and the separator.

Another object of the present disclosure is to provide a scroll compressor in which a balancer compensating for eccentricity and the separator are simultaneously installed in the drive unit, such that spatial utilization of the compressor can be maximized.

Another object of the present disclosure is to provide a scroll compressor in which the separator and the balancer are integrated into one unit, thereby improving installation convenience.

Another object of the present disclosure is to provide a scroll compressor for enabling oil collected in the separator to directly flow into an oil reservoir space of the compressor case, thus preventing congestion or accumulation of such oil flowing into the compressor.

Another object of the present disclosure is to provide a scroll compressor acting as a balancer capable of removing unbalance of the compressor before oil collected in the separator is discharged outside.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a compressor may include a case configured to include a discharge part provided at one side thereof and a reservoir space provided at the other side thereof such that refrigerant is discharged through the discharge part and oil is stored in the reservoir space, a drive unit configured to include a stator that generates a rotary magnetic field by coupling to an inner circumferential surface of the case, and a rotor that is contained in the stator and rotates by the rotary magnetic field, a rotary shaft coupled in a direction farther from the discharge part in the rotor, a compression unit coupled to the rotary shaft so as to be lubricated with oil, configured to compress the refrigerant, and discharge the compressed refrigerant in a direction farther from the discharge part, a muffler coupled to the compression unit so as to guide the refrigerant to the discharge part, a separator coupled to at least one of the rotor and the rotary shaft so as to separate the oil from the refrigerant guided to the discharge part, and a coupling unit configured to fix the separator to at least one of the rotor and the rotary shaft.

The separator may include a coupling body coupled to at least one of the rotor and the rotary shaft, and a separation body formed to extend from an outer circumferential surface of the coupling body to the discharge part.

The coupling unit may include a fastening member coupled to the rotary shaft after passing through the coupling body, and a fixing member coupled to or in contact with the fastening member so as to prevent the fastening member from being relatively rotated with respect to the coupling body.

The separator may include a coupling body coupled to at least one of the rotor and the rotary shaft, and a separation body extending from an outer circumferential surface of the coupling body to the discharge part. The coupling unit may include a first fastening member that is coupled to the rotary shaft after passing through the coupling body, and a second fastening member that is coupled to the rotor after passing through the coupling body.

The separator may include a coupling body coupled to at least one of the rotor and the rotary shaft, and a separation body extending from an outer circumferential surface of the coupling body to the discharge part. The coupling unit may include a fastening member that is coupled to the rotor after passing through the coupling body.

The fastening member may be implemented as a plurality of fastening members so that the plural fastening members are symmetrically coupled to the coupling body with respect to the rotary shaft.

The separator may include a coupling body coupled to at least one of the rotor and the rotary shaft, and a separation body extending from an outer circumferential surface of the coupling body to the discharge part. The coupling unit may include at least one fastening member coupled to pass through both the coupling body and the rotor.

The fastening member may include a first body seated in the coupling body, an extension body formed to extend from the first body so as to pass through the rotor, and a second body formed to extend from the extension body or coupled to the extension body in a manner that the second body is exposed outside the rotor.

The compressor may further include a balancer coupled to the drive unit so as to compensate for vibration or eccentricity of the compression unit. The separator may be configured to receive the balancer therein.

The separator may include a coupling body coupled to at least one of the rotor and the rotary shaft, and a separation body extending from an outer circumferential surface of the coupling body to the discharge part. The balancer may be received in the separation body.

The coupling unit may include a fastening member coupled to at least one of the rotor and the rotary shaft after passing through at least one of the balancer and the coupling body.

The fastening member may be coupled to the rotor after passing through both the balancer and the coupling body. The fastening member may be implemented as a plurality of fastening members. At least one fastening member may be coupled to the rotor after passing through only the coupling body, and the remaining fastening members other than the at least one fastening member may be coupled to the rotor after passing through both the coupling body and the balancer.

The fastening member may pass through all of the balancer, the coupling body, and the rotor. The fastening member may include a first body seated in an exposure surface of the balancer, an extension body formed to extend from the first body or coupled to the first body in a manner that the extension body passes through the balancer, the coupling body, and the rotor, and a second body formed to extend from the extension body or coupled to the extension body in a manner that the second body is exposed outside the rotor.

The separator may be formed integrally with the balancer.

The separator may further include a discharge hole formed to pass through an outer circumferential surface of the separation body in a manner that the oil is discharged through the discharge hole.

The discharge hole may be provided at a region in which the separation body is in contact with the coupling body.

The discharge hole may be spaced apart in a direction from the coupling body to the discharge part by a predetermined distance.

The discharge hole may be located at a position facing the balancer.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF SPECIFIC EMBODIMENTS

Reference will now be made in detail to the embodiments of the present disclosure, examples of which are illustrated in the accompanying drawings. Wherever possible, the same reference numbers will be used throughout the drawings to refer to the same or similar parts. A singular expression may include a plural expression unless otherwise stated in the context. In the following description, a detailed description of related known configurations or functions incorporated herein will be omitted to avoid obscuring the subject matter. The accompanying drawings illustrate the exemplary embodiments of the present disclosure. The exemplary embodiments of the present disclosure are merely provided to describe the present disclosure in detail, and the technical range of the present disclosure is not limited by the exemplary embodiments.

Figure 1A:
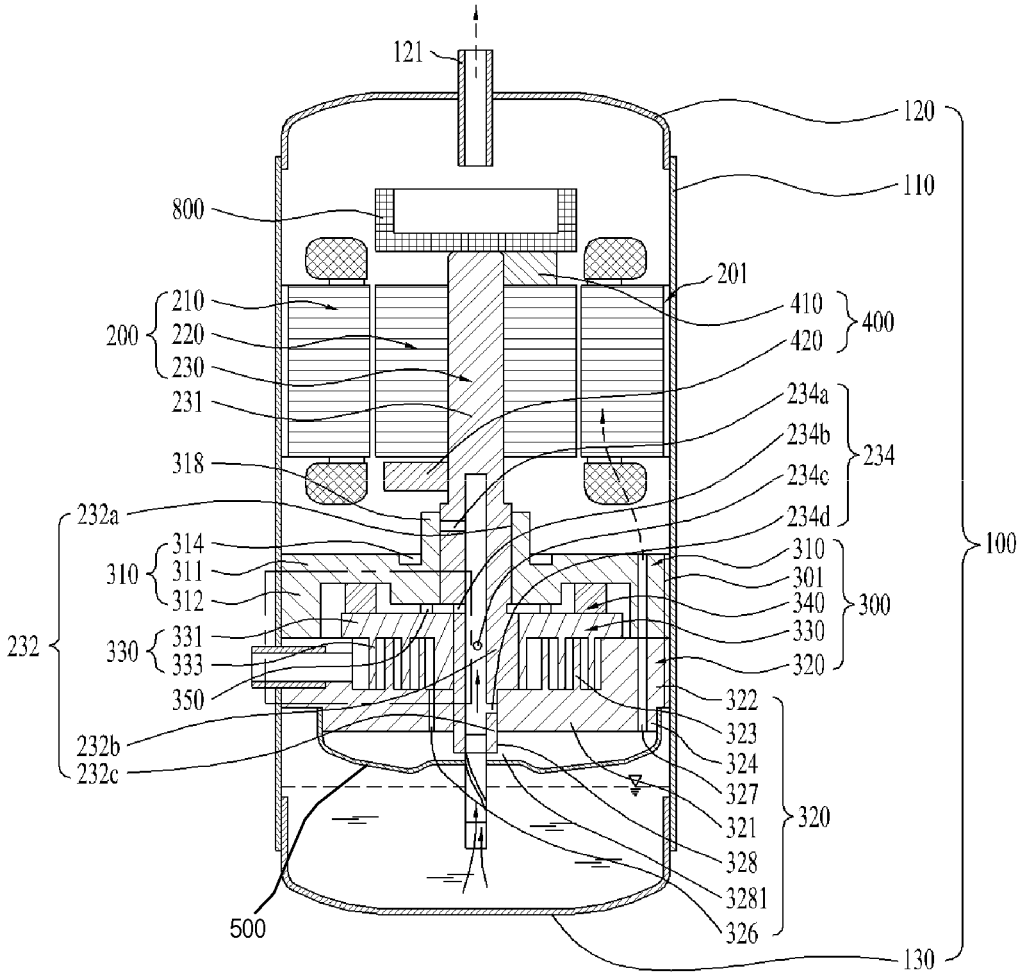
FIGS. 1A and 1B are views illustrating the principal components of a lower scroll compressor and functions of a separator according to the embodiment of the present disclosure.
Figure 1B:
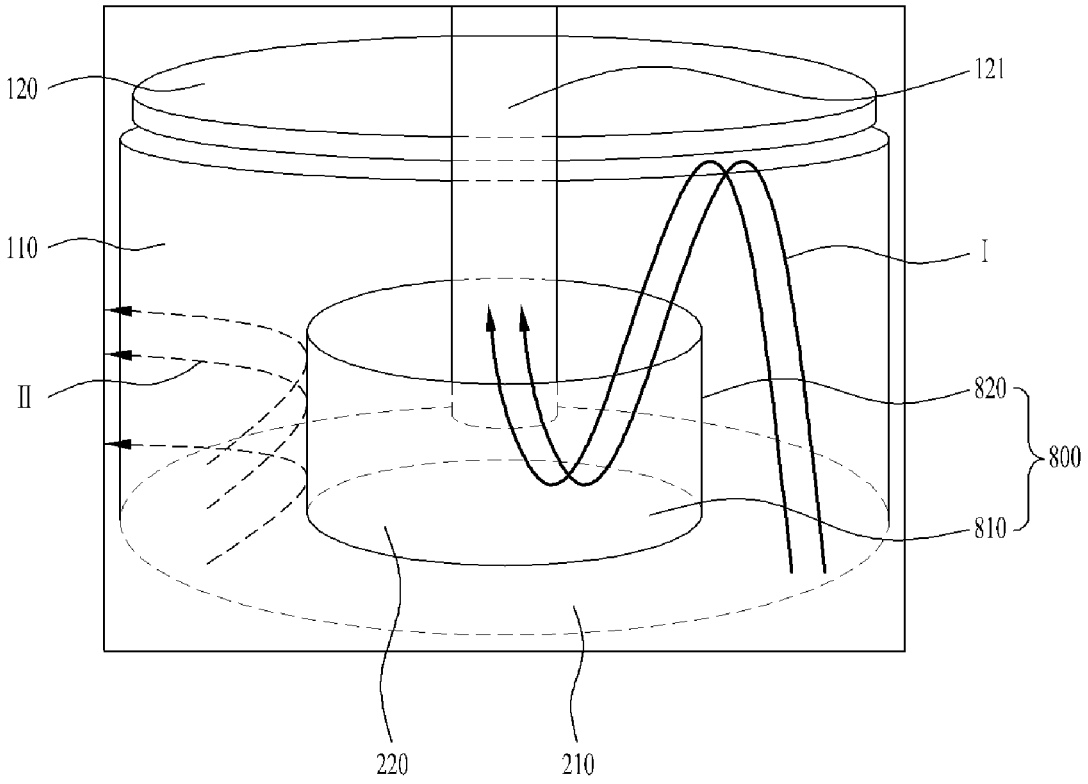

FIGS. 1A and 1B are views illustrating the principal components of a lower scroll compressor 10 and functions of a separator according to the embodiment of the present disclosure. In more detail, FIG. 1A is a view illustrating an internal structure of the lower scroll compressor according to the present disclosure, and FIG. 1B is an enlarged view illustrating the separator for separating oil and refrigerant from each other.

Referring to FIG. 1A, the scroll compressor 10 may include a case 100, a drive unit 200, and a compression unit 300. The case 100 may include a reservoir space in which fluid is stored or moves. The drive unit 200 may be coupled to an inner circumferential surface so as to rotate a rotary shaft 230. The compression unit 300 may be coupled to the rotary shaft 230 in the case 100, and may be provided to compress fluid.

In more detail, the case 100 may include a discharge part 121 provided at one side thereof so that refrigerant is discharged through the discharge part 121. The case 100 may include a reception shell 110, a discharge shell 120, and an isolation shell 130. The reception shell 110 may be formed in a cylindrical shape, and may include the drive unit 200 and the compression unit 300. The discharge shell 120 may be connected to one end of the reception shell 110, and may include the discharge part 121. The isolation shell 130 may be coupled to the other end of the reception shell, and may seal the reception shell 110.

The drive unit 200 may include a stator 210 to generate a rotary magnetic field, and a rotor 220 to rotate by the rotary magnetic field. The rotary shaft 230 may be coupled to the rotor 220, so that the rotary shaft 230 can rotate together with the rotor 220.

The stator 210 may include a plurality of slots. The plurality of slots may be formed at the inner circumferential surface of the stator 210 in a circumferential direction of the stator 210. Coils may be wound on the slots of the stator 210, so that the stator 210 can be fixed to the inner circumferential surface of the reception shell 110. The rotor 220 may be coupled to a permanent magnet, and may be rotatably coupled in the stator 210 to generate rotational power. The rotary shaft 230 may be press-fitted into a center point of the rotor 220.

The compression unit 300 may include a fixed scroll 320, an orbiting scroll 330, and a main frame 310. The fixed scroll 320 may be coupled to the reception shell 110, and may be provided in the drive unit 200 in the direction farther from the discharge part 121. The orbiting scroll 330 may be coupled to the rotary shaft 230, and may be engaged with the fixed scroll 320, resulting in formation of a compression chamber. The main frame 310 may include the orbiting scroll 330, and may be seated in the fixed scroll 330, resulting in formation of an outer appearance of the compression unit 330.

As a result, the lower scroll compressor 10 may include the drive unit 200 disposed between the discharge port 120 and the compression unit 300. In other words, the drive unit 200 may be provided at one side of the discharge part 120, and the compression unit 300 may be provided in the drive unit 200 in the direction farther from the discharge part 121. For example, when the discharge part 121 is provided at an upper part of the case 100, the compression unit 300 may be provided at a lower part of the drive unit 200, and the drive unit 200 may be disposed between the discharge part 120 and the compression unit 300.

As a result, when oil is stored in a bottom surface of the case 100, the oil can be directly supplied to the compression unit 300 without passing through the drive unit 200. In addition, the rotary shaft 230 is coupled to the compression unit 300 and supports the compression unit 300, so that a separate lower frame for rotatably supporting the rotary shaft 230 can be omitted from the compressor. On the other hand, the lower scroll compressor 10 according to the present disclosure may enable the rotary shaft 230 to pass through the orbiting scroll 330 and the fixed scroll 320, so that the rotary shaft 230 may be designed to be in surface contact with the orbiting scroll 330 and the fixed scroll 320.

Accordingly, inflow force (suction force) generated when fluid such as refrigerant flows into the compression unit 300, gas force generated when the refrigerant is compressed in the compression unit 300, and reaction force supporting the gas force may be applied to the rotary shaft 230 without change. Therefore, the inflow force, the gas force, and the reaction force may be applied to a single action point. As a result, no overturning moments are applied to the orbiting scroll 320 connected to the rotary shaft 230, so that tilting (or vibration) or overturning of the orbiting scroll 320 can be basically prevented. In other words, even axial vibration from among vibrations generated by the orbiting scroll 330 may be attenuated or prevented, and the overturning moments of the orbiting scroll 330 may also be attenuated or suppressed. As a result, vibration and noise generated in the lower scroll compressor 10 can be blocked.

In addition, the rotary shaft 230 may be in surface contact with the fixed scroll 320 in a manner that the fixed scroll 320 can be supported by the rotary shaft 230. Thus, even when the inflow force and the gas force are applied to the rotary shaft 230, durability of the rotary shaft 230 can be reinforced.

In addition, the rotary shaft 230 may absorb or support some parts of back pressure generated when the refrigerant is discharged outside, such that the rotary shaft 230 can reduce force (i.e., normal force) generated when the orbiting scroll 330 excessively and closely adheres to the fixed scroll 320 in the axial direction. As a result, frictional force between the orbiting scroll 330 and the fixed scroll 230 can be greatly reduced.

As a result, the compressor 10 may attenuate the axial tilting and overturning moments of the orbiting scroll 330 installed in the compression unit 300, and may reduce frictional force of the orbiting scroll 330, resulting in improvement in efficiency and reliability of the compression unit 300.

On the other hand, the main frame 310 from among constituent elements of the compression unit 300 may include a main end plate 311, a main side plate 312, and a main bearing 318. The main end plate 311 may be provided either at one side of the drive unit 200 or at a lower part of the drive unit 300. The main side plate 312 may extend farther from the drive unit 200 at the inner circumferential surface of the main end plate 311, and may be seated in the fixed scroll 330. The main bearing 318 may extend from the main end plate 311, and may rotatably support the rotary shaft 230.

The main end plate 311 or the main side plate 312 may further include a main hole through which refrigerant discharged from the fixed scroll 320 can be guided to the discharge part 121.

The main end plate 311 may further include an oil pocket 314 formed to be recessed at the outside of the main bearing 318. The oil pocket 314 may be formed in a circular shape, and may be eccentrically disposed in the main bearing 318.

When oil stored in the isolation shell 130 is transferred through the rotary shaft 230 or the like, the oil pocket 314 may allow the oil to flow into a portion where the fixed scroll 320 is engaged with the orbiting scroll 330.

The fixed scroll 320 may include a fixed end plate 321, a fixed side plate 322, and a fixed wrap 323. The fixed end plate 321 may be coupled to the reception shell 110 in the direction farther from the drive unit 300 in the main end plate 311, and may form the other surface of the compression unit 300. The fixed side plate 322 may extend from the fixed end plate 321 to the discharge part 121, and may be in contact with the main side plate 312. The fixed wrap 323 may be provided at the inner circumferential surface of the fixed side plate 322, and may form a compression chamber in which refrigerant is compressed.

Meanwhile, the fixed scroll 320 may include a fixed through-hole 328 and a fixed bearing 3281. The fixed through-hole 328 may be formed to enable the rotary shaft 230 to pass therethrough. The fixed bearing 3281 may extend from the fixed through-hole and may rotatably support the rotary shaft. The fixed bearing 3281 may be provided at the center of the fixed end plate 321. The fixed end plate 321 may be identical in thickness to the fixed bearing 3281. In this case, the fixed bearing 3281 may not extend without protruding from the fixed scroll 321, and may be interpolated into the fixed through-hole 328.

The fixed side plate 322 may allow the fixed wrap 323 to have an inlet hole 325 through which refrigerant is introduced, and may allow the fixed end plate 321 to have a discharge hole 326 through which the refrigerant is discharged. Although the discharge hole 326 is provided in the central direction of the fixed wrap 323, the discharge hole 326 may be spaced apart from the fixed bearing 3281 to prevent interference with the fixed bearing 3281, and the discharge hole 326 may also be implemented as a plurality of discharge holes 326 as necessary.

The orbiting scroll 330 may include an orbiting end plate 331 disposed between the main frame 310 and the fixed scroll 320, and an orbiting wrap 333 that forms a compression chamber along with the fixed wrap 323 at the orbiting end plate 331.

The orbiting scroll 330 may further include an orbiting through-hole 338 formed to pass through the orbiting end plate 331 in a manner that the rotary shaft 230 is rotatably coupled to the orbiting through-hole 338.

The rotary shaft 230 may be designed in a manner that a portion coupled to the orbiting through-hole 338 is eccentrically formed. Thus, when the rotary shaft 230 rotates, the orbiting scroll 330 may move while being engaged with the fixed wrap 323 of the fixed scroll 320, and may thus compress the refrigerant Specifically, the rotary shaft 230 may include a main shaft 231 and a bearing unit 232. The main shaft 231 may be coupled to the drive unit 200, and may rotate. The bearing unit 232 may be connected to the main shaft 231, and may be rotatably coupled to the compression unit 300. The bearing unit 232 may be formed of a separate member different from the main shaft 231, so that the bearing unit 232 may include the main shaft 231 therein and may be integrally formed with the main shaft 231.

The bearing unit 232 may include a main bearing unit 232*c*, a fixed bearing unit 232*a*, and an eccentric shaft 232*b*. The main bearing unit 232*c* may be inserted into the main bearing 318 of the main frame 310, and may be supported in a radial direction. The fixed bearing unit 232*a* may be inserted into the fixed bearing 3281, and may be supported in a radial direction. The eccentric shaft 232*b* may be disposed between the main bearing unit 232*c* and the fixed bearing unit 232*c*, and may be inserted into the orbiting through-hole 338 of the orbiting scroll 330.

In this case, the main bearing unit 232*c* and the fixed bearing unit 232*c* may be coaxially formed to have the same axial center. The eccentric shaft 232*b* may have a center of gravity that is formed eccentrically in the radial direction with respect to the fixed bearing unit 232*c* or the fixed bearing unit 232*a*. In addition, the outer diameter of the eccentric shaft 232*b* may be larger than the outer diameter of the main bearing unit 232*c* or the outer diameter of the fixed bearing unit 232*a*. As such, during rotation of the bearing unit 232, the eccentric shaft 232*b* enables the orbiting scroll 330 to perform orbital motion and at the same time provides force to compress the refrigerant. The orbiting scroll 330 may regularly perform such orbital motion by the eccentric shaft 232*b* in the fixed scroll 320.

However, in order to prevent rotation of the orbiting scroll 320, the compressor 10 according to the present disclosure may further include an Oldham ring 340 coupled to an upper part of the orbiting scroll 320. The Oldham ring 340 may be disposed between the orbiting scroll 330 and the main frame 310, and may contact both the orbiting scroll 330 and the main frame 310. The Oldham ring 340 may linearly move in four directions (i.e., forward, backward, left and right) so as to prevent rotation of the orbiting scroll 320.

Meanwhile, the rotary shaft 230 may be formed to completely pass through the fixed scroll 320 such that the rotary shaft 230 may protrude outward from the compression unit 300. As a result, the rotary shaft 230 may directly contact the outside of the compression unit 300 and oil stored in the isolation shell 130. The rotary shaft 230 rotates, and at the same time supplies oil to the compression unit 300.

The oil may flow into the compression unit 300 through the rotary shaft 230. The rotary shaft 230 or the indoor space of the rotary shaft 230 may be provided with an oil supply passage 234 through which the oil can be supplied to the outer circumferential surface of the main bearing unit 232*c*, the outer circumferential surface of the fixed bearing unit 232*a*, and the outer circumferential surface of the eccentric shaft 232*b*.

In addition, a plurality of oil holes 234*a*, 234*b*, 234*c*, and 234*d* may be formed in the oil supply passage 234. In more detail, the oil holes may be classified into a first oil hole 234*a*, a second oil hole 234*b*, a third oil hole 234*c*, and a fourth oil hole 234*d*. The first oil hole 234*a* may be formed to pass through the outer circumferential surface of the main bearing unit 232*c*.

The first oil hole 234*a* may be formed to pass through the circumferential surface of the main bearing unit 232*c* in the oil supply passage 234. Although the first oil hole 234*a* is formed to pass through, for example, the upper part of the outer circumferential surface of the main bearing unit 232*c*, the scope or spirit of the present disclosure is not limited thereto. That is, the first oil hole 234*a* may also be formed to pass through the lower part of the outer circumferential surface of the main bearing unit 232*c* as needed. For reference, the first oil hole 234*a* may also include a plurality of holes differently from the drawings. If the first oil hole 234*a* includes the plurality of holes, the respective holes may also be formed only at the upper or lower part of the outer circumferential surface of the main bearing unit 232*c*, and the holes may also be respectively formed at the upper part and the lower part of the outer circumferential surface of the main bearing unit 232*c*. In addition, the rotary shaft 230 may include an oil feeder 233. The oil feeder 233 may pass through a muffler 500 so as to contact oil stored in the case 100. The oil feeder 233 may include an extension shaft 233*a* and a spiral groove 233*b*. The extension shaft 233*a* may pass through the muffler 500 and may thus contact the oil. The spiral groove 233*b* may be spirally formed at the outer circumferential surface of the extension shaft 233*a*, and may communicate with the supply passage 234.

As a result, when the rotary shaft 230 rotates, the oil may move up through the oil feeder 233 and the oil supply passage 234 due to the shape of the spiral groove 233*b*, viscosity of the oil, and a pressure difference between a high pressure region and an intermediate pressure region of the compression unit 300, such that the oil may be discharged to the plurality of oil holes. The oil discharged through the plurality of oil holes 234*a*, 234*b*, 234*d*, and 234*e* may form an oil film between the fixed scroll 250 and the orbiting scroll 240, may maintain an airtight state, may absorb frictional heat generated from a frictional part between the constituent elements of the compression unit 300, and may radiate heat.

The oil guided along the rotary shaft 230 through the first oil hole 234*a* may lubricate the main frame 310 and the rotary shaft 230. In addition, the oil may be discharged through the second oil hole 234*b*, and may be supplied to the top surface of the orbiting scroll 240. The oil supplied to the top surface of the orbiting scroll 240 may be guided to the intermediate pressure chamber through the pocket groove 314. For reference, oil discharged not only through the second oil groove 234*b*, but also through the first oil groove 234*a* or the third oil groove 234*d* may also be supplied to the pocket groove 314.

On the other hand, oil guided along the rotary shaft 230 may be supplied not only to the Oldham ring 340 disposed between the orbiting scroll 240 and the main frame 230, but also to the fixed side plate 322 of the fixed scroll 320, such that the degree abrasion of the fixed side plate 322 of the fixed scroll 320 and the degree of abrasion of the Oldham ring 340 can be reduced. In addition, oil supplied to the third oil hole 234*c* is also supplied to the compression chamber, such that the degree of abrasion caused by friction between the orbiting scroll 330 and the fixed scroll 320 can be reduced. In addition, an oil film is formed, and heat radiation is performed, resulting in improvement in compression efficiency.

Meanwhile, although the above-mentioned description relates to the centrifugal oil-feeding structure for allowing the lower scroll compressor 10 to supply oil to the bearing using rotation of the rotary shaft 230, the scope or spirit of the present disclosure is not limited thereto, and it should be noted that the present disclosure can also be applied not only to a differential pressure oil-feeding structure for supplying oil using a difference between inner pressures of the compression unit 300, but also to a forced oil supply structure for supplying oil through a trochoid pump or the like without departing from the scope or spirit of the present disclosure.

On the other hand, the compressed refrigerant may be discharged through the discharge hole 326 along the space formed by the fixed wrap 323 and the orbiting wrap 333. It is more preferable that the discharge hole 326 be formed toward the discharge part 121. This is because it is most preferable that the refrigerant discharged through the discharge hole 326 be transferred to the discharge part 121 without a large change in the flow direction.

However, due to structural characteristics of the compressor in which the compression unit 300 should be disposed in the direction farther from the discharge part 121 in the drive unit 200 and the fixed scroll 320 should be disposed at the outermost part of the compression unit 300, the discharge hole 326 may be provided in a manner that the refrigerant can be sprayed in the direction opposite to the discharge part 121.

In other words, the discharge hole 326 may be provided in a manner that the refrigerant can be sprayed in the direction farther from the discharge part 121 in the fixed end plate 321. Therefore, when the refrigerant flows into the discharge hole 326 without change, the refrigerant may not be smoothly discharged through the discharge part 121. When the oil is stored in the isolation shell 130, there is a possibility that the refrigerant collides with the oil so that the refrigerant may be cooled or mixed with the oil.

In order to solve the above-mentioned issue, the compressor 10 according to the present disclosure may further include a muffler 500 that is coupled to the outermost portion of the fixed scroll 320 and provides a space through which the refrigerant can be guided to the discharge part 121.

The muffler 500 may be formed to seal one surface arranged in the direction farther from the discharge part 121 from among several surfaces of the fixed scroll 320 such that the refrigerant discharged from the fixed scroll 320 can be guided to the discharge part 121.

The muffler 500 may include a coupling body 520 and a reception body 510. The coupling body 520 may be coupled to the fixed scroll 320. The reception body 510 may extend from the coupling body 520, and may form a sealed space. As a result, the flow direction of the refrigerant sprayed from the discharge hole 326 may be changed along the sealed space formed by the muffler 500, such that the resultant refrigerant can be discharged through the discharge part 121.

Meanwhile, the fixed scroll 320 is coupled to the reception shell 110, such that flow of the refrigerant may be disturbed by the fixed scroll 320 and the refrigerant may have difficulty in flowing to the discharge part 121. Thus, the fixed scroll 320 may further include a bypass hole 327 that passes through the fixed end plate 321 in a manner that the refrigerant can pass through the fixed scroll 320. The bypass hole 327 may communicate with the main hole 327. As a result, the refrigerant may sequentially pass through the compression unit 300 and the drive unit 200, and may finally be discharged through the discharge hole 121.

On the other hand, the refrigerant may be compressed at a higher pressure as the distance from the outer circumferential surface of the fixed wrap 323 to the innermost region of the fixed wrap 323 increases, so that the inside of the fixed wrap 323 and the inside of the orbiting wrap 333 can be maintained at a high pressure. Therefore, discharge pressure can be applied to the back surface of the orbiting scroll without change, and back pressure acting as a reaction to the discharge pressure may occur in the direction from the orbiting scroll to the fixed scroll. The compressor 10 may further include a back-pressure seal 350 that enables the back pressure to be concentrated at a coupling portion between the orbiting scroll 320 and the rotary shaft 230 so that a leakage between the orbiting wrap 333 and the fixed wrap 323 can be prevented.

The back-pressure seal 350 may be formed in a ring shape in a manner that the inner circumferential surface thereof can be maintained at a high pressure, and the outer circumferential surface of the back-pressure seal 350 may be separated to be maintained at an intermediate pressure lower than the high pressure. Thus, the back pressure can be concentrated at the inner circumferential surface of the back-pressure seal 350, so that the orbiting scroll 330 can be in close contact with the fixed scroll 320.

In this case, considering that the discharge hole 326 is spaced apart from the rotary shaft 230, the center point of the back-pressure seal 250 may be biased to the discharge hole 326. On the other hand, when refrigerant is discharged through the discharge part 121, the oil supplied to the compression unit 300 or the oil stored in the case 100 may move along with the refrigerant in an upward direction of the case 100. In this case, the oil may have higher density than the refrigerant so that the oil may not move to the discharge part 121 by centrifugal force generated by the rotor 220 and may be attached to the inner walls of the discharge shell 110 and the reception shell 120. Each of the drive unit 200 and the compression unit 300 of the lower scroll compressor 10 may further include a recovery flow passage at the outer circumferential surface thereof in a manner that oil attached to the inner wall of the case 100 can be collected either in the reservoir space of the case 100 or in the isolation shell 130.

The recovery passage may include a drive recovery passage 201 provided at the outer circumferential surface of the drive unit 200, a compression recovery passage 301 provided at the outer circumferential surface of the compression unit 300, and a muffler recovery passage 501 provided at the outer circumferential surface of the muffler 500.

The drive recovery passage 201 may be formed when some parts of the outer circumferential surface of the stator 210 are recessed. The compression recovery passage 301 may be formed when some parts of the outer circumferential surface of the fixed scroll 320 are recessed. In addition, the muffler recovery passage 501 may be formed when some parts of the outer circumferential surface of the muffler are recessed. The drive recovery passage 201, the compression recovery passage 301, and the muffler recovery passage 501 may communicate with one another in a manner that oil can pass through the drive recovery passage 201, the compression recovery passage 301, and the muffler recovery passage 501.

As described above, the center of gravity of the rotary shaft 230 may be biased to one side due to the eccentric shaft 232*b*, unbalanced eccentric moments may occur in rotation of the rotary shaft 230, so that overall unbalance may be distorted. Therefore, the lower scroll compressor 10 according to the present disclosure may further include a balancer 400 capable of offsetting eccentric moments caused by the eccentric shaft 232*b*.

Since the compression unit 300 is fixed to the case 100, it is more preferable that the balancer 400 be coupled to the rotary shaft 230 or the rotor 220. Therefore, the balancer 400 may include a central balancer 410 and an outer balancer 420. The central balancer 400 may be provided either at the lower end of the rotor 220 or at one surface facing the compression unit 300 in a manner that eccentric load of the eccentric shaft 232*b* can be offset or reduced. The outer balancer 420 may be coupled to the upper end of the rotor 220 or the other surface facing the discharge part 121 in a manner that the eccentric load or the eccentric moment of at least one of the eccentric shaft 232*b* and the lower balancer 420 can be offset or cancelled.

The central balancer 410 may be provided in relatively close proximity to the eccentric shaft 232*b*, so that the central balancer 410 can directly offset the eccentric load of the eccentric shaft 232*b*. Thus, the central balancer 410 may be biased in the direction opposite to the eccentric direction of the eccentric shaft 232*b*. As a result, even when the rotary shaft 230 rotates at a low speed or at a high speed, the rotary shaft 230 is located closer to the eccentric shaft 232*b*, so that eccentric force or eccentric load generated by the eccentric shaft 232*b* can be effectively offset or cancelled in a substantially uniform manner.

The outer balancer 420 may also be biased in the direction opposite to the eccentric direction of the eccentric shaft 232*b*. However, the outer balancer 420 may also be biased in the direction corresponding to the eccentric shaft 232*b* in a manner that the eccentric load generated by the central balancer 410 can be partially offset or cancelled. Thus, the central balancer 410 and the outer balancer 420 may offset the eccentric moments generated by the eccentric shaft 232*b*, and may assist the rotary shaft 230 to stably rotate.

Referring to FIG. 1B, the refrigerant, that is discharged from the compression unit 300 and is guided by the muffler 500, may move to the discharge part 121 after passing through the drive unit 200. The refrigerant may be compressed at a high temperature and high pressure so that the refrigerant is transitioned to a gaseous state. As a result, the refrigerant can pass through the inside of the stator 210 or the inside of the rotor 220, or may pass through a gap between the stator and the rotor. Simultaneously, oil supplied through lubrication of the compression unit 300 may be mixed with the refrigerant, so that the refrigerant mixed with the oil may pass through the drive unit 200 without change and may be discharged through the discharge part 121.

The refrigerant has a relatively low density, so that the refrigerant may be discharged through the discharge part 121 in the direction (I) without being affected by rotation of the rotor 220. However, the oil may have a much higher density than the refrigerant, may collide with the refrigerant, so that the oil and the refrigerant may be intermingled with each other. Thus, when the rotor 220 rotates, centrifugal force may be applied to the oil so that the resultant oil may leak to the inner circumferential surface of the case 100 in the direction (II) without flowing to the discharge part 121.

However, if the refrigerant is discharged through the discharge part 121 at a very high speed, some parts of the oil may be mixed with the refrigerant irrespective of centrifugal force formed by the rotor, so that the resultant oil mixed with the refrigerant may leak to the discharge part 121.

In order to prevent the above-mentioned issue, the lower scroll compressor 10 may include a separator 800 coupled to at least one of the rotor 220 and the rotary shaft 230 so that the oil can be separated from the refrigerant guided to the discharge part 121 by the separator 800.

The separator 800 may include a coupling body 810 and a separation body 820. The coupling body 810 may be coupled to at least one of the rotor 220 and the rotary shaft 230. The separation body 820 may extend from the outer circumferential surface of the coupling body 810 to the discharge part 121.

The coupling body 810 may be formed in a circular disc shape that is larger in diameter than the rotary shaft 230. The separator body 820 may be formed in a cylindrical shape extending from the outer circumferential surface of the coupling body 810.

Therefore, the separation body 820 may create greater centrifugal force than the rotor 220 while simultaneously rotating, and may thus stereoscopically create the centrifugal force in the axial direction of the rotary shaft 230. As a result, the oil passing through the drive unit 200 may not be directed to the discharge part 121 by strong centrifugal force generated by the separation body 820, and may collide with the inner circumferential surface of the reception shell 110 or the inner wall of the discharge shell 120 in the direction (II).

In this case, when oil collides with the case 100, the oil may be immediately transitioned to oil droplets, such oil droplets may be aggregated together so that the volume of the oil droplets may unavoidably increase. Thus, the oil may move along the side surfaces of the drive unit 200 and the compression 300 through the recovery passage 200 due to weight of the oil, such that the resultant oil may be recovered into the reservoir space provided in the isolation shell 130.

As a result, the lower scroll compressor 10 may be designed in a manner that the separator 800 rotates together with the rotor 220 and the refrigerant is discharged through the discharge part 121. In contrast, the oil may be guided to the inner wall of the case 100 so that the refrigerant and the oil can be separated from each other.

Meanwhile, the separator 800 may be coupled to at least one of the rotary shaft 230 and the rotor 220. Since the separator 800 rotates at a high speed, the separator 800 may be coupled to the rotary shaft 230 or the rotor through a separate fastening member or welding or the like so as to acquire sufficient coupling force. However, when the lower scroll compressor 10 is driven, the drive unit 200 may be suddenly accelerated at a high speed or may be suddenly decelerated at a low speed. As a result, significant inertial force may be applied to the separator 800 so that the separator 800 may be unexpectedly separated from the drive unit 200.

Thus, the lower scroll compressor 10 may further include a coupling unit 900. The coupling unit 900 may prevent the separator 800 from being separated from the rotor 220 or the rotary shaft 230.

FIGS. 2A to 2E are views illustrating one example of the coupling unit 900 capable of ensuring the coupling force of the separator 800 according to the present disclosure.

Figure 2A:
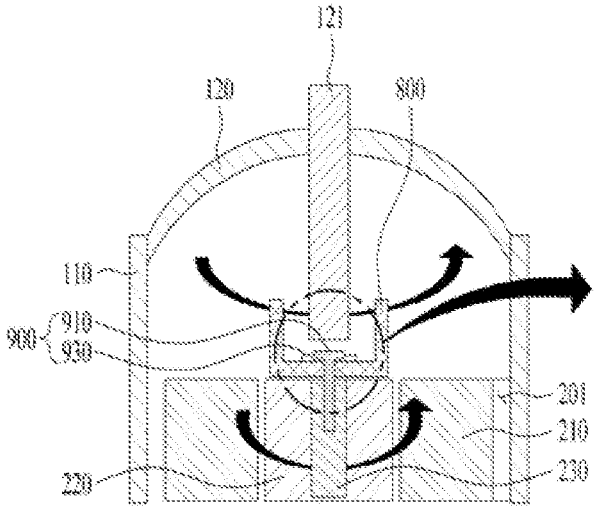
FIGS. 2A to 2E are views illustrating a coupling unit for coupling the separator to the drive unit according to an embodiment of the present disclosure.

Referring to FIG. 2A, the coupling unit 900 may include a first fastening member 910. The first fastening member 910 may pass through the coupling body 810 and is coupled to the rotary shaft 230.

The fastening member 910 may be coupled to the rotary shaft 230 after passing through the center of the coupling body 810, and may be provided as a member such as a bolt. The rotary shaft 230 may further include a fastening groove located at one end thereof. The fastening groove may be coupled to the first fastening member 910 at one end of the rotary shaft 230.

Since the rotary shaft 230 corresponds to the center of rotation, the first fastening member 910 may enable the separator 800 to be stably coupled to the rotary shaft 230 irrespective of rotation of the separator 800. However, since the fastening member 910 is located at the center of rotation, there is a high possibility that coupling of the fastening member 910 may be unexpectedly released by inertial force generated in the direction opposite to the rotation direction.

In order to address the above-mentioned issues, the coupling unit 900 according to the present disclosure may further include a fixing member 930. The fixing member 930 may prevent the first fastening member 910 from relatively rotating with respect to the coupling body 810. The fixing member 930 may enable the first fastening 9810 and the fixing member 930 to always be integrally rotated, so that the first member 930 may prevent the first fastening member 910 from being rotated separately from the coupling body so that the first fastening member 910 is not separated from the coupling body 810.

Figure 2B:
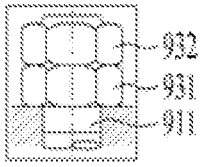

Referring to FIG. 2B, the first fastening member 910 may include a screw 911. The screw 911 may include a screw groove formed at the outer circumferential surface thereof, so that the screw 911 may be coupled to the rotary shaft 230 after passing through the coupling body 910. The fixing member 930 may include a first nut 931 and a second nut 932. The first nut 931 may be coupled to the screw 911, and may connect the screw to the coupling body 810 and the rotary shaft 230. The second nut 932 may be coupled to the screw 911 at one side of the first nut 931 so as to prevent rotation of the first nut 931.

The screw provided at the inner circumferential surface of the first nut 931 and the screw provided at the inner circumferential surface of the second nut 932 may be located in opposite directions. Thus, the first nut 931 and the second nut 932 may fix the position of the screw 911 in a complementary manner, irrespective of rotational force or inertial force applied to the screw 911.

Figure 2C:
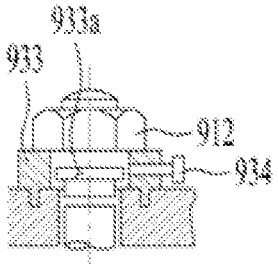

Referring to FIG. 2C, the first fastening member 910 may include a bolt 912 that passes through the coupling body 910 and is coupled to the rotary shaft 230. The fixing member 930 may include a washer disposed between the bolt 912 and the coupling body 910, and a fixing pin 934 inserted into a washer hole 933*a* provided in the washer 933 so as to fix the bolt 912. The washer 933 may strengthen contact force between the bolt 912 and the coupling body 910, and the fixing pin 934 may strengthen coupling force between the bolt 912 and the washer 912, so that the bolt 912 may be prevented from being arbitrarily rotated at the rotary shaft 230.

Figure 2D:
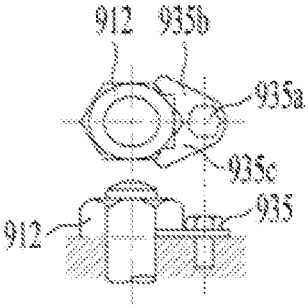

Referring to FIG. 2D, the first fastening member 910 may include a bolt 912 that passes through the coupling body 910 and is coupled to the rotary shaft 230. The fixing member 930 may include an auxiliary fixing unit 934 that prevents arbitrary rotation of the bolt 912 by closely contacting the outer circumferential surface of the bolt 912.

The auxiliary fixing unit 934 may include a fixed shaft 934*a*, a first fixed end 934*b*, and a second fixed end 934*a*. The fixed shaft 934*a* may be spaced apart from the bolt 912 and may be coupled to the rotary shaft 230 or the rotor 220. The first fixed end 934*b* may extend from the fixed shaft 934*a* to the outer circumferential surface of the bolt 912. The second fixed end 934*c* may be spaced apart from the first fixed end 934*b*, and may extend to the outer circumferential surface of the bolt 912. The first fixed end 934*b* and the second fixed end 934*c* may extend to hold the bolt 912 at the fixed shaft 934*a*, so that the first fixed end 934*b* and the second fixed end 934*c* may prevent the bolt 912 from being arbitrarily rotated.

Figure 2E:
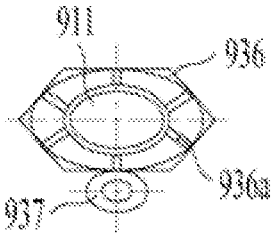

Referring to FIG. 2E, the first fastening member 910 may be implemented as the screw 911. The fixing member 930 may include a third nut 936 and a coupling pin 937. The third nut 936 may be coupled to the outer circumferential surface of the screw 911 and may enable the screw 911 to be fixed to the rotary shaft 230. The coupling pin 937 may pass through the third nut 936, and may enable the screw 911 to be fixed to the rotary shaft 230. In other words, the third nut 936 may include a plurality of coupling holes 936*a*. The coupling holes 936*a* may pass through each of the outer circumferential surface and the inner circumferential surface of the third nut 936. The coupling pin 937 may be inserted into at least one of the coupling holes 936*a*, so that the coupling pin 937 can prevent the third nut 936 and the screw 911 from being arbitrarily rotated.

As a result, the lower scroll compressor 10 may couple the separator 800 to the drive unit 200 through the first fastening member 910, and may prevent the separator 800 from being separated from the drive unit 200 through the fixing member 930.

Figure 3A:
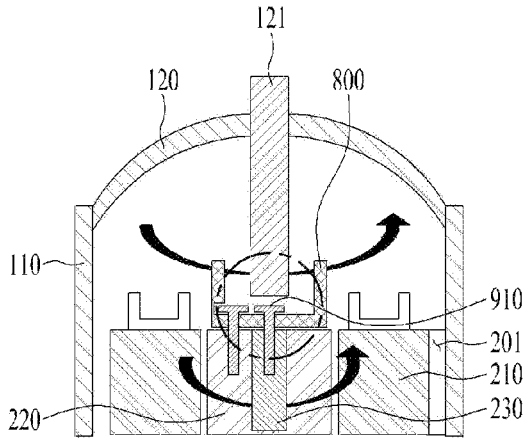
FIGS. 3A and 3B are views illustrating a coupling unit for coupling the separator to the drive unit according to another embodiment of the present disclosure.
Figure 3B:
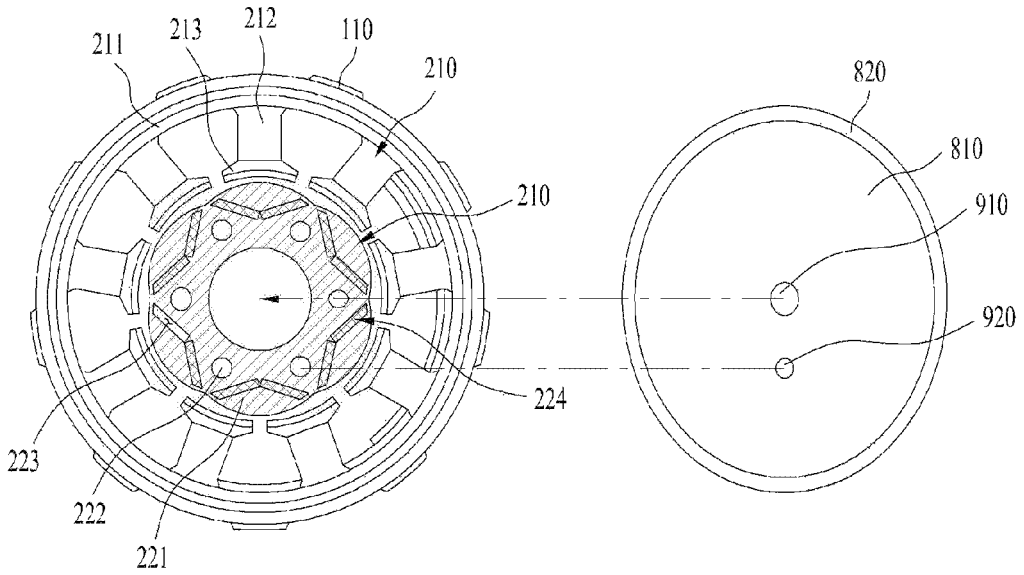

FIGS. 3A and 3B are views illustrating another example of the coupling unit 900 provided in the lower scroll compressor 10 according to the present disclosure.

Referring to FIG. 3A, the coupling unit 900 of the lower scroll compressor 10 may include a first fastening member 910 and a second fastening member 920. The first fastening member 910 may be coupled to the rotary shaft 230 after passing through the coupling body 810. The second fastening member 920 may be coupled to the rotor 220 after passing through the coupling body 910.

The first fastening member 910 may couple the separator 800 to the rotary shaft 230. The second fastening member 920 may prevent the separator 800 from being arbitrarily rotated at the rotary shaft 230. That is, the second fastening member 920 may be spaced apart from the center of rotation of the separator 800, and may enable the separator 800 to be fixed, so that the first fastening member 910 or the separator 800 can be prevented from being relatively rotated with respect to the rotary shaft 230. Thus, coupling between the separator 800 and the drive unit 200 can be firmly maintained.

Referring to FIG. 3B, the stator 210 may include a fixed body 211, a teeth part 212, and a pole shoe 213. The fixing body 211 may be coupled to the inner circumferential surface of the reception shell 110. The teeth part 212 may extend from the fixing body 211 to the inside of the reception shell 110 in a manner that a coil can be wound on the teeth part 212. The pole shoe 213 may prevent the coil from escaping from the free end of the teeth part 212, and may control the direction of a magnetic field generated in the coil.

The teeth part 212 may be implemented as a plurality of teeth parts 212 so that the teeth parts 212 may be spaced apart from each other at intervals of a predetermined distance at the inner circumferential surface of the fixed body 211. The free end of the pole shoe 213 may form a space in which the rotor 220 can rotate. When current is applied to the coil wound on the teeth parts 212 or a changed current is applied to the coil wound on the teeth parts 212, an induced magnetic field may occur, and the pole shoe 213 may enable the magnetic field to be concentrated or amplified so that the amplified magnetic field can be applied to the rotor 220.

The rotor 220 may be implemented by stacking a plurality of steel plates, and may rotate by the magnetic field. Specifically, the rotor 220 may include a rotary body 221, at least one coupling hole 222, and at least one insertion hole 223. The rotary shaft 230 may be inserted into the rotary body 221 so that the rotary body 221 can be coupled to the rotary shaft 230. The coupling hole 222 may be formed to be penetrated in the circumferential direction of the rotary shaft 230 in the rotary body 221. A magnetic body 224 to generate rotational force by a magnetic field at the outside of the coupling hole 222 may be inserted into the insertion hole 223.

The insertion hole 223 may be formed to include the magnetic body 224 therein so that the insertion hole 223 may prevent separation of the magnetic body 224. The insertion hole 223 may be formed to correspond to the shape or position of the magnetic body 224. The magnetic body 224 may be implemented as a permanent magnet or the like, and may create rotational force by a magnetic field generated either in the pole shoe 213 or in the coil.

Meanwhile, the coupling hole 222 may be used for coupling of the rotary body 221 when the rotary body 221 is implemented as a stacked structure of plural plates. Therefore, the second fastening member 920 may be coupled to the coupling hole 222. As a result, the rotor 220 can be coupled to the second fastening member 920 without using a separate space or component, so that the separate space or component can be omitted from the compressor.

The first fastening member 910 may be coupled to the rotary shaft 230 inserted into the rotor 220 after passing through the coupling body 810, so that the separator 800 can be fixed to the rotary shaft 230 through the first fastening member 910. In addition, the second fastening member 920 may be coupled to the coupling hole 222 after passing through the coupling body 810, so that the separator 800 can be coupled to the drive unit 200 and at the same time the first fastening member 910 can be prevented from being arbitrarily rotated.

In contrast, the second fastening member 920 may be implemented as a plurality of second fastening members 920, so that the second fastening members 920 may also be coupled to at least two of the plurality of coupling holes 222.

Figure 4A:
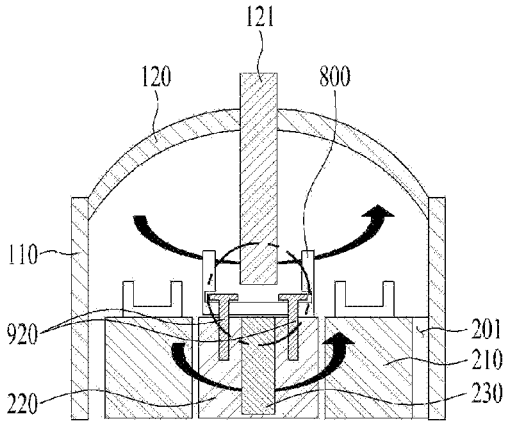
FIGS. 4A and 4B are views illustrating a coupling unit for coupling the separator to the drive unit according to still another embodiment of the present disclosure.
Figure 4B:
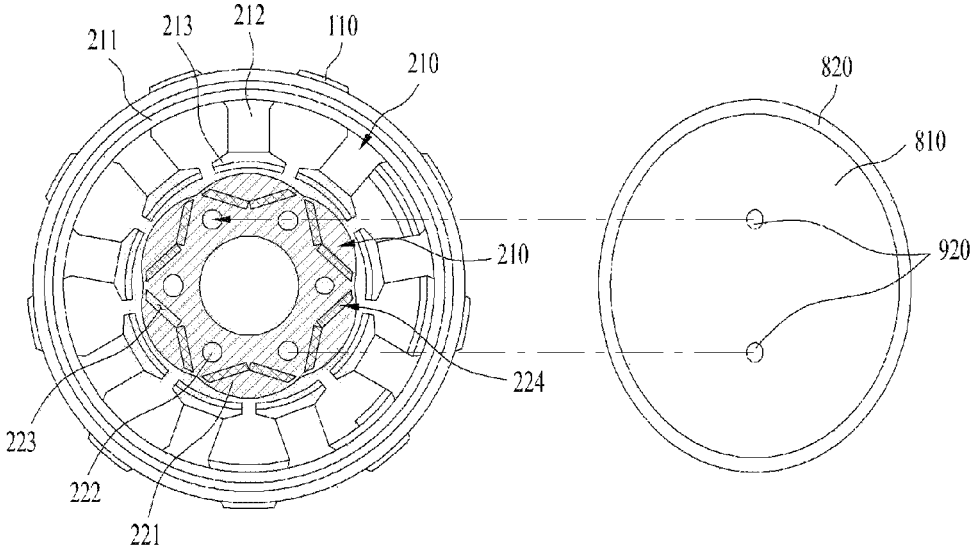

FIGS. 4A and 4B are views illustrating still another example of the coupling unit 900 provided in the lower scroll compressor 10 according to the present disclosure.

Since the first fastening member 910 is located at the center of rotation of the separator 800, inertial force separated from the rotary shaft 230 may be intensively applied to the first fastening member 910 whenever the rotation speed of the rotary shaft 230 is changed.

Therefore, the coupling unit 900 of the lower scroll compressor 10 may include only the second fastening member 920 that is coupled to the rotor 230 after passing through the coupling body 810. In other words, the coupling unit 900 may include only the second fastening member 920 other than the first fastening member 910.

Since the second fastening member 920 is spaced apart from the center of rotation of the separator 800, inertial force may not be exactly matched with the direction through which the second fastening member 920 is separated from the rotor 220 although the rotation speed of the rotary shaft 230 is changed. Thus, although the coupling unit 900 includes only the second fastening member 920, coupling force between the separator 800 and the drive unit 200 can be maintained.

In addition, the second fastening member 920 may be implemented as a plurality of second fastening member members 920, so that the second fastening members 920 may be coupled to at least two of the coupling holes 222. As such, inertial forces generated by the plural second fastening members 920 may be supported or distributed. As a result, the entirety of the second fastening members 920 can be prevented from being arbitrarily rotated.

In this case, it is preferable that the second fastening members 920 be arranged symmetrically to the rotary shaft 230 in a manner that the separator 800 can be stably coupled and inertial force can be evenly distributed or maintained. In other words, in the event that the second fastening member 920 is implemented as two or more second fastening members 920, the second fastening members 920 may be coupled to the coupling holes 222 that are arranged in a point-symmetrical shape with respect to the rotary shaft 230.

Figure 5:
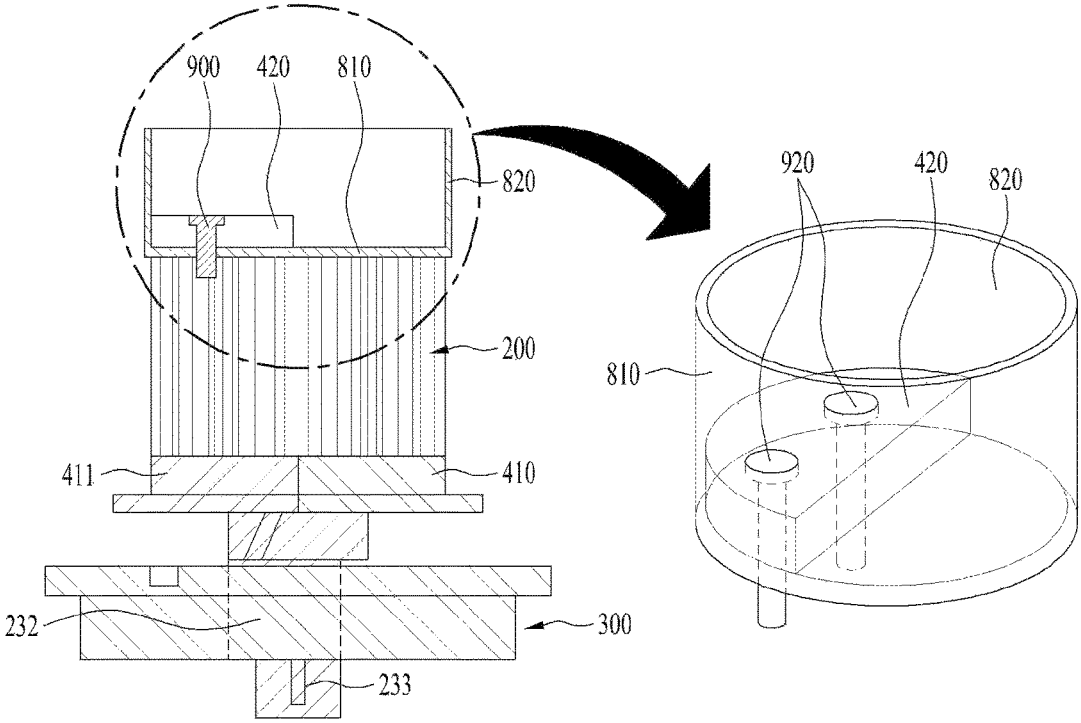
FIG. 5 is a view illustrating a method for simultaneously coupling the balancer compensating for eccentricity and the separator to the lower scroll compressor according to an embodiment of the present disclosure.

FIG. 5 is a view illustrating a method for simultaneously coupling the balancer compensating for eccentricity and the separator to the lower scroll compressor according to an embodiment of the present disclosure.

Referring to FIG. 5, the balancer 400 of the lower scroll compressor 10 may include a central balancer 410 that is coupled to one side or a lower part of the drive unit 220 to compensate for eccentricity of the eccentric part 232 provided to the rotary shaft 230.

In addition, the balancer 400 may further include a counter balancer 411. The counter balancer 411 may be lighter in weight than the central balancer 410, so that the position of the central balancer 410 can be fixed by the counter balancer 411. The counter balancer 411 and the central balancer 410 may be integrated into one unit. The counter balancer 411 may have an inner space therein, or may be formed of a material having a lower density than the central balancer 410.

As described above, the balancer 400 may further include the outer balancer 420. The outer balancer 420 may compensate for both eccentricity of the central balancer 410 and eccentricity of the rotary shaft 230. The outer balancer 420 may be more focused to compensate for the eccentricity of the central balancer 410, rather than focused to compensate for the eccentricity of the rotary shaft 230.

On the other hand, the separator 800 can maximize the effect of separating refrigerant and oil from each other, so that the separator 800 must be located in close proximity to the discharge part 121. In addition, the outer balancer 420 has to compensate for eccentricity of the central balancer 410, such that the outer balancer 420 should be arranged in the direction of one surface where the separator 800 is disposed from among several surfaces of the drive unit 200. Accordingly, in the event that the separator 800 and the outer balancer 420 are simultaneously disposed in the drive unit 200, complicated coupling may occur or the inner space of the compressor 10 may be unnecessarily occupied as shown in FIG. 1A.

To this end, the lower scroll compressor 10 according to the present disclosure may be provided such that the separator 800 includes the balancer 400. Specifically, the separator 800 may be designed to include the outer balancer 420 therein. In other words, the outer balancer 420 may be in contact with one surface of the coupling body 810, so that the outer balancer 420 can be contained in the separation body 820. In addition, the outer balancer 420 may be in contact with the inner circumferential surface of the separation body 820.

The coupling unit 900 may include a fastening member that is coupled to at least one of the rotor 220 and the rotary shaft 230 after passing through both the outer balancer 420 and the coupling body 810. The outer balancer 420 may be arranged to have eccentricity about the drive unit 200. Thus, it is more preferable that the coupling unit 900 be coupled to the rotor 220, rather than coupled to the rotary shaft 230.

Therefore, the second fastening member 920 may pass through both the balancer 400 and the coupling body 810, so that the second fastening member 920 can be coupled to the rotor 230. That is, the second fastening member 920 may be coupled to the coupling hole 222 after passing through the outer balancer 420 and the coupling body 810. As a result, the second fastening member 920 may firmly couple the outer balancer 420 and the coupling body 819 to the drive unit 200.

Meanwhile, the second fastening member 920 may be implemented as a plurality of second fastening members 920. As a result, each of the second fastening members 920 can be prevented from being arbitrarily rotated, so that the coupling of the second fastening members 920 can be maintained.

In addition, the coupling unit 900 may include the second fastening member 920 and the first fastening member 910, so that the balancer 400 and the coupling body 810 can be coupled to the rotary shaft 230 through the coupling unit 900.

Figure 6:
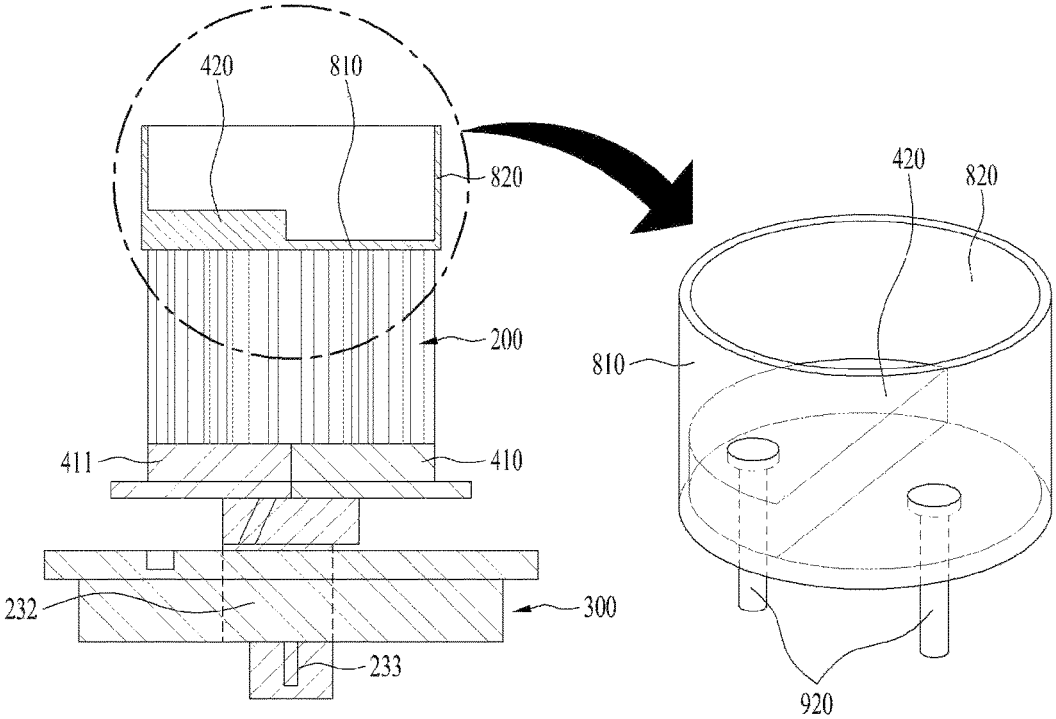
FIG. 6 is a view illustrating a method for simultaneously coupling the balancer compensating for eccentricity and the separator to the lower scroll compressor according to another embodiment of the present disclosure.

FIG. 6 is a view illustrating a method for simultaneously coupling both the balancer compensating for eccentricity and the separator to the lower scroll compressor according to another embodiment of the present disclosure.

The second fastening member 920 may be implemented as the plurality of second fastening members 920, so that at least one second fastening member 920 may be coupled to the rotor after passing through only the coupling body 810 and the remaining second fastening members 920 other than the at least one second fastening member may be coupled to the rotor after passing through the balancer 400 and the coupling body 810.

Thus, some parts of the coupling body 810 can be prevented from being separated from the drive unit 200 during rotation of the rotor 220.

In this case, the respective second fastening members 920 may be arranged in a point-symmetrical shape with respect to the rotary shaft 230. On the other hand, the outer balancer 420 and the separator 810 may be completely integrated into one unit. Thus, the process or means for coupling the outer balancer 420 to the separator 800 may be omitted as necessary. In addition, only the separator 800 is coupled to the drive unit 200, such that the effect capable of being acquired by additional installation of the outer balancer 420 can also be easily obtained by the compressor. Furthermore, the compressor can also enable the outer balancer 420 to be fixed therein by fixing of only the separator 800.

In this case, the coupling unit 900 may include only the second fastening member 920 while excluding the third fastening member 920. Thus, the coupling unit 900 need not pass through the balancer 400, and weight (or load) of the balancer 400 can be maintained.

Figure 7:
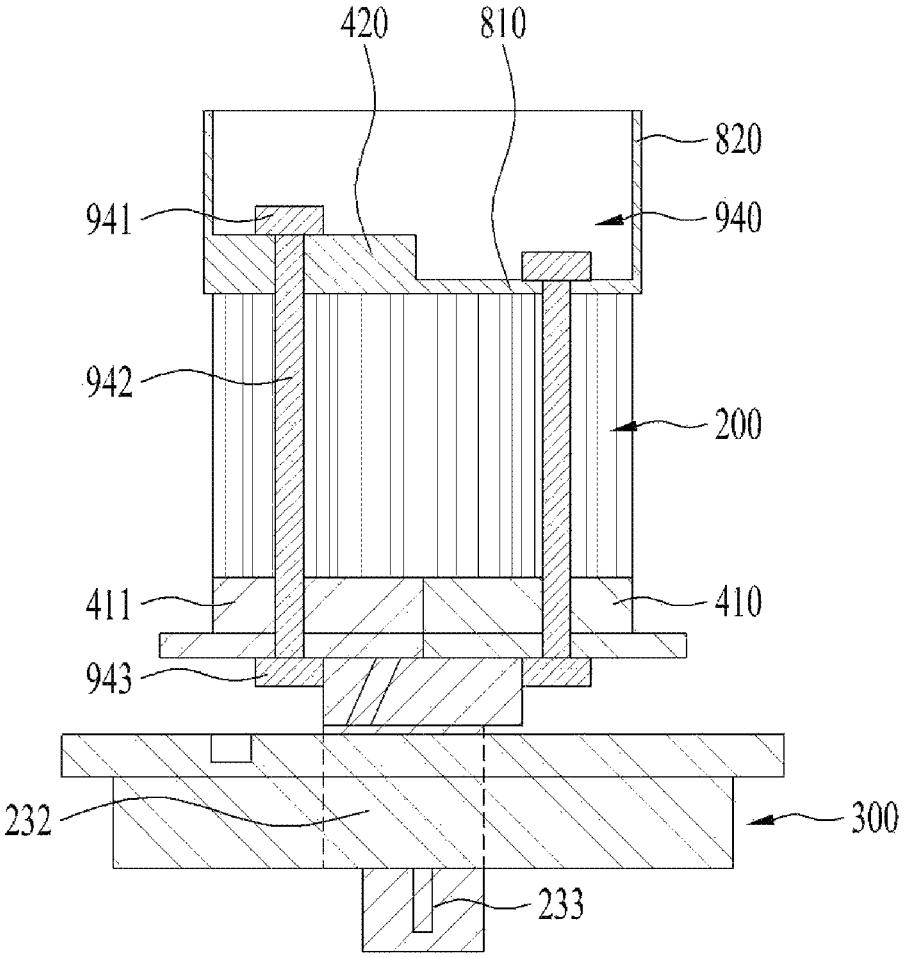
FIG. 7 is a view illustrating a method for simultaneously coupling the balancer compensating for eccentricity and the separator to the lower scroll compressor according to still embodiment of the present disclosure.

FIG. 7 is a view illustrating still another example of the coupling unit 900 according to the present disclosure.

Referring to FIG. 7, the coupling unit 300 may further include a third fastening member 940 that is coupled to the separator 800 after passing through both the balancer 400 and the rotor 220.

The third fastening member 940 may pass through at least one of the coupling body 810, the rotor 220, the lower balancer 410, and the counter balancer 411, such that the separator 800 can be coupled to the drive unit 300.

Therefore, the separator 800 can be stably fixed to the drive unit 300 irrespective of excessive vibration generated in the drive unit 200. In addition, coupling force between the balancer 400 and the drive unit 300 can be further strengthened, resulting in increased operational stability of the compressor.

The third fastening member 940 may extend from one end of the rotor 220 to the other end of the rotor 220, and may be coupled to the rotor 230 in the direction parallel to the rotary shaft 230.

The third fastening member 940 may be implemented as a plurality of third fastening members 940 as needed. Thus, at least one third fastening member 940 may pass through the outer balancer 420 contained in the separator 800, and may extend to the lower balancer 410 or the counter balancer 412. The remaining third fastening members 940 other than the at least one third fastening member 940 may sequentially pass through the separation body 810 and the rotor 220, so that the remaining third fastening members 940 may extend to the lower balancer 410 or the counter balancer 411.

Therefore, the coupling unit 900 may stably couple the separator 800 to the drive unit 200 even when the center of gravity of the separator 800 is eccentrically disposed due to the presence of the outer balancer 420.

Here, one third fastening member formed to pass through the outer balancer 420 may be different in length than the other third fastening member formed to pass through only the coupling body 810. As a result, the third fastening member 940 can be in surface contact with the exposure surface of the coupling body 810 or the exposure surface of the outer balancer 420, such that coupling force and grip force can be maximized.

The third fastening member 940 may include a first body 941, an extension body 942, and a second body 943. The first body 941 may be seated on the exposure surface of any one of the separator 800 and the outer balancer 420. The extension body 942 may extend from the first body 941, and may be coupled to the first body 941, so that the extension body 942 passes through the rotor. The second body 942 may extend from the extension body 942, or may be coupled to the extension body 942, so that the second body 942 can be seated in the exposure surface of the counter balancer 411 or the central balancer 410.

The diameter of the extension body 942 may be shorter than each of the diameter of the first body 941 and the diameter of the second body 943, and the extension body 842 may be contained in the coupling hole 222. In this case, in the situation in which the rotor 220 is implemented as a stacked structure of the plurality of steel plates, the extension body 942 may also serve to fix the position of each steel plate.

On the other hand, whereas the first body 941 and the second body 942 are integrated into one unit, the third body 942 may be detachably coupled to the second body 942. That is, each of the first body 941 and the second body 942 may be implemented as a bolt, and the third body may be implemented as a nut coupled to the bolt.

Figure 8A:
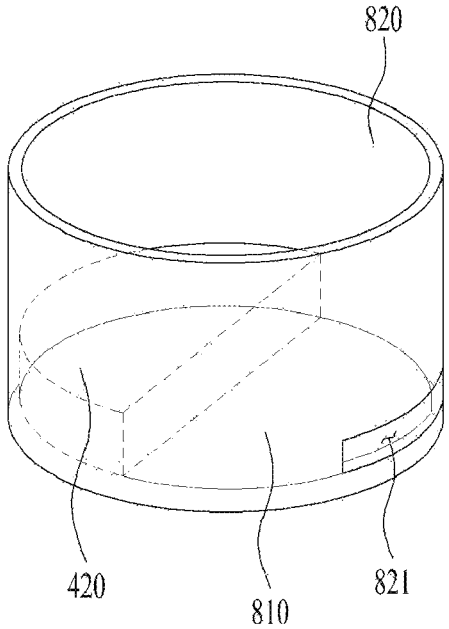
FIGS. 8A and 8B are conceptual diagrams illustrating a method for enabling oil collected in the separator to be directly discharged outside according to the present disclosure.
Figure 8B:
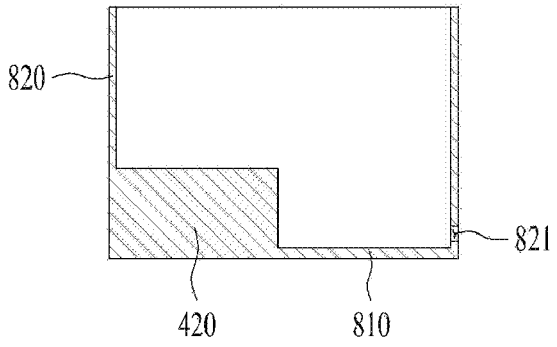

FIGS. 8A and 8B are conceptual diagrams illustrating a method for discharging oil through the separator 800 according to the present disclosure.

FIG. 8A is a perspective view illustrating the separator 800, and FIG. 8B is a cross-sectional view illustrating the separator 800.

The separator 800 may be coupled to the coupling unit 900, and may rotate along with the rotor 220, so that strong centrifugal force can be generated in the vicinity of the discharge part 121. Thus, oil may flow in the direction from the outer circumferential surface of the separation body 820 to the inner circumferential surface of the case 100 by such centrifugal force supplied from the separation body 820.

However, oil introduced into the inside of the separator 800 may be attached to the inner wall of the separation body 820 by centrifugal force generated by the separation body 820, and may be collected in the reservoir. According to lapse of time, the amount of oil flowing into the separator 800 may greatly increase so that a significant amount of oil may be accumulated in the separator 800. If the significant amount of oil is accumulated in the separation body 820, the weight of the separator 800 may unavoidably increase, so that performance of the drive unit 200 may be deteriorated. In addition, the amount of oil stored in the case 100 is gradually reduced, so that unexpected problems may occur in the process of supplying the sufficient amount of oil to the compression unit 300. In addition, when the oil is accumulated in the separator 800, the oil level may unavoidably increase to the vicinity of the discharge part 121, so that the oil may unexpectedly leak to the discharge part 121.

In order to solve the above-mentioned issues, the separator 800 may further include a discharge hole 821 formed to pass through the outer circumferential surface of the separation body 820 so that the oil can be discharged through the discharge hole 821.

The discharge hole 821 may be provided at a lower end of the separation body 820, or may also be formed over the coupling body 810. As such, oil can be discharged through the discharge hole 821 by centrifugal force that is generated by rotation of the separator 800 as soon as the oil is received in the separator 800.

In addition, the discharge hole 821 may be located to face the balancer 400 contained in the separator 800. In other words, the discharge hole 821 may be arranged symmetrical to the balancer 400 with respect to the rotary shaft 230.

In contrast, the discharge part 821 may be spaced apart in the direction from the coupling body 810 to the discharge part 121 by a predetermined distance. As such, the separator 800 can be filled with a predetermined amount of oil, so that the oil can serve as the counter balancer of the outer balancer 420.

In addition, the discharge part 821 may be smaller in width than the outer balancer 400.

As a result, the speed of discharging such oil may be reduced, so that the oil can act as the counter balancer for a longer period of time.

Figure 9A:
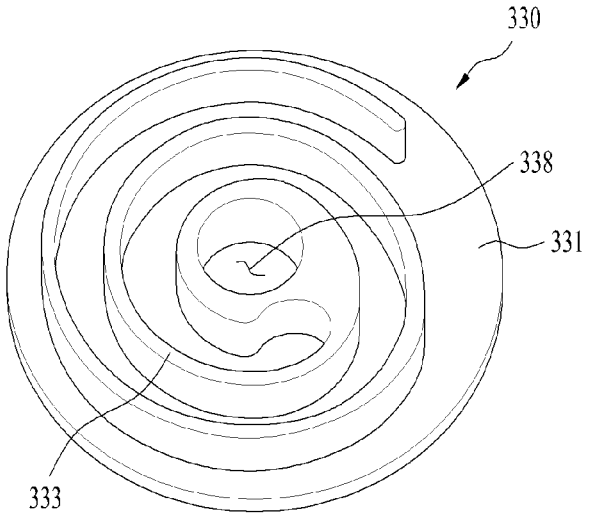
FIGS. 9A to 9C are conceptual diagrams illustrating a method for operating the lower scroll compressor according to the present disclosure.
Figure 9B:
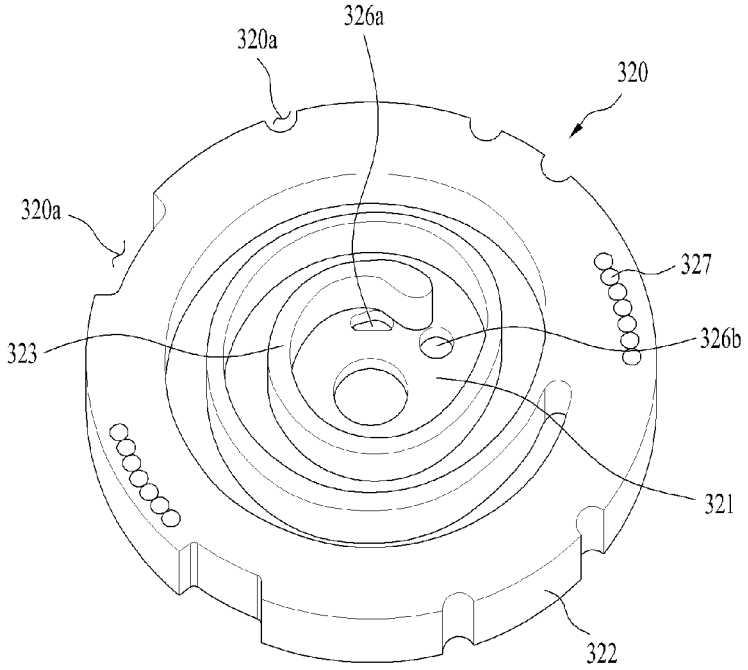
Figure 9C:
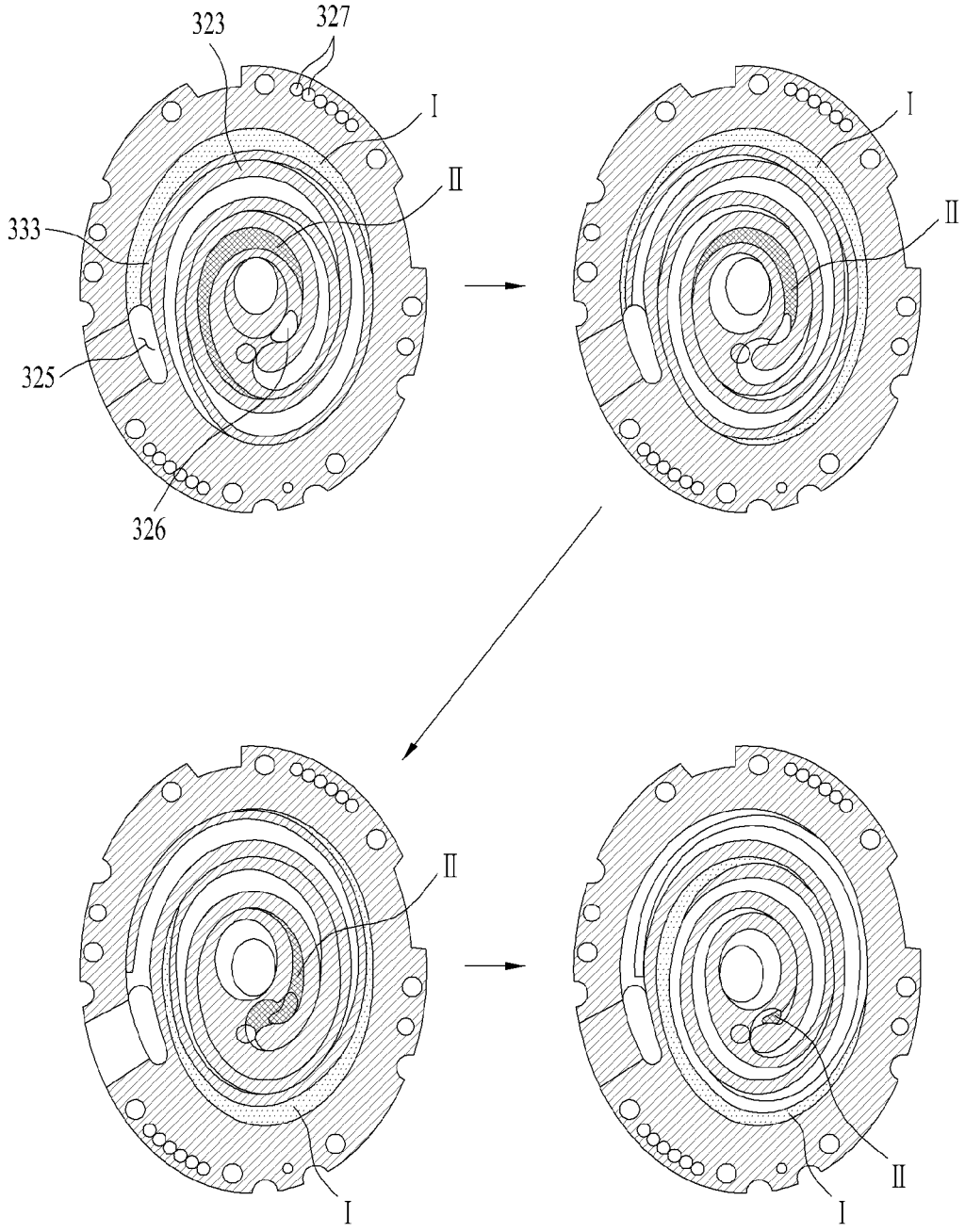

FIGS. 9A to 9C are conceptual diagrams illustrating a method for operating the lower scroll compressor 10 according to the present disclosure. In more detail, FIG. 9A is a view illustrating the orbiting scroll, FIG. 9B is a view illustrating the fixed scroll, and FIG. 9C is a view illustrating a process for compressing refrigerant using the orbiting scroll and the fixed scroll.

The orbiting scroll 330 may include an orbiting wrap 333 located at one side of the orbiting end plat 331. The fixed scroll 320 may include a fixed wrap 323 located at one side of the fixed end plate 321.

Whereas the orbiting scroll 330 may be formed of a sealed rigid body to prevent refrigerant from being discharged outside, the fixed scroll 320 may include an inlet hole 325, a discharge hole 326, and a bypass hole 327. In more detail, the inlet hole 325 may communicate with a refrigerant supply pipe such that low-temperature and low-pressure refrigerant such as liquid refrigerant can be introduced through the inlet hole 325. The discharge hole 326 may be formed such that high-temperature and high-pressure refrigerant can be discharged through the discharge hole 326. The bypass hole 327 may be formed at the outer circumferential surface of the fixed scroll 320, so that refrigerant discharged through the discharge hole 326 can be discharged through the bypass hole 327.

Meanwhile, each of the fixed wrap 323 and the orbiting wrap 333 may be formed in an involute shape, such that at least two points between the fixed wrap 323 and the orbiting wrap 333 are engaged with each other, resulting in formation of a compression chamber in which the refrigerant is compressed.

In the situation in which thread wound around a basic circle having a preset radius is unwound or untangled, the involute shape may refer to a curved line corresponding to a trajectory that is drawn by the end of the thread.

However, each of the fixed wrap 323 and the orbiting wrap 333 may be formed by combination of at least 20 arcs, and the radius of curvature of each of the fixed wrap 323 and the orbiting wrap 333 may be changed per section.

In other words, the compressor according to the present disclosure may enable the rotary shaft 230 to pass through the fixed scroll 320 and the orbiting scroll 330, so that the radius of curvature and the compression space of each of the fixed wrap 323 and the orbiting wrap 333 may be reduced.

Therefore, in order to compensate for such reduction in the compression space and the radius of curvature, the compressor according to the present disclosure may be designed to reduce the size of a refrigerant discharge space as well as to increase the compression ratio. In more detail, just before the refrigerant is discharged through the fixed wrap 323 and the orbiting wrap 333, each of the curvature radius of the fixed wrap 323 and the curvature radius of the orbiting wrap 333 may be formed to be shorter than the bearing having passed through the rotary shaft.

In other words, each of the fixed wrap 323 and the orbiting wrap 333 may be excessively curved in the vicinity of the discharge hole 326. As each of the fixed wrap 323 and the orbiting wrap 333 extends to the inlet hole 325, different radiuses of curvature may be obtained from the respective curved sections of the fixed wrap 323 or the orbiting wrap 333.

Referring to FIG. 9C, refrigerant (I) may be introduced into the inlet hole 325 of the fixed scroll 320. Refrigerant (II) introduced into the inlet hole 323 earlier than the refrigerant (I) may be located in the vicinity of the discharge hole 326 of the fixed scroll 320.

In this case, the refrigerant (I) may be present in a region in which the fixed wrap 323 is engaged with the orbiting wrap 333 at the outer surface of the orbiting wrap 333, and the other refrigerant (II) may be sealed and present in another region in which at least two points between the fixed wrap 323 and the orbiting wrap 333 are engaged with each other.

Thereafter, when the orbiting scroll 330 starts orbiting motion, the two-point engagement region between the fixed wrap 323 and the orbiting wrap 333 may gradually move in the extension direction of each of the fixed wrap 323 and the orbiting wrap 333 so that reduction of an overall volume is started. Compression of the refrigerant (I) may also be started together with such reduction in volume. The refrigerant (II) may be compressed while being further reduced in volume, so that the resultant refrigerant (II) can be guided to the discharge hole 326.

The refrigerant (II) may be discharged through the discharge hole 326. As the two-point engagement region between the fixed wrap 323 and the orbiting wrap 333 gradually moves in a clockwise direction, the refrigerant (I) may also move in the clockwise direction, volume of the refrigerant (I) is further reduced, resulting in a higher compression ratio of the refrigerant (I).

As the two-point engagement region between the fixed wrap 323 and the orbiting wrap 333 re-moves in the clockwise direction, the distance to the inside of the fixed scroll becomes shorter, volume of the refrigerant (II) is further reduced, resulting in a higher compression ratio of the refrigerant (II), and discharge of the refrigerant (II) may almost be completed.

As described above, as the orbiting scroll 330 performs orbital motion, the refrigerant may flow into the fixed scroll so that the refrigerant can be linearly or continuously compressed.

Although the above-mentioned drawings have disclosed that the refrigerant discontinuously flows into the inlet hole 325 for convenience of description, the scope or spirit of the present disclosure is not limited thereto, and it should be noted that the refrigerant can be continuously supplied to the inlet hole 325. In addition, such refrigerant may be received in each of the two-point engagement regions between the fixed wrap 323 and the orbiting wrap 333, such that the resultant refrigerant can be compressed.

As is apparent from the above description, the scroll compressor according to the embodiments of the present disclosure may enable the separator that separates refrigerant and oil from each other to always be kept in a fixed state in the compressor in any situation.

The scroll compressor according to the embodiments of the present disclosure may maintain a coupling force between the drive unit supplying power and the separator.

The scroll compressor according to the embodiments of the present disclosure may be designed such that the balancer compensating for eccentricity and the separator are simultaneously installed in the drive unit, such that spatial utilization of the compressor can be maximized.

The scroll compressor according to the embodiments of the present disclosure may be designed such that the separator and the balancer are integrated into one unit, thereby improving installation convenience.

The scroll compressor according to the embodiments of the present disclosure may enable oil collected in the separator to directly flow into an oil reservoir space of the compressor case, and may thus prevent congestion or accumulation of such oil flowing into the compressor.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

What is claimed is:

1. A compressor comprising:

a case that comprises a discharge part disposed at one side of the case to discharge refrigerant, and a reservoir space configured to store oil;

a drive unit comprising (i) a stator coupled to an inner circumferential surface of the case and configured to generate a rotary magnetic field and (ii) a rotor disposed inside the stator and configured to rotate relative to the stator by the rotary magnetic field;

a rotary shaft coupled to the rotor;

a compression unit coupled to the rotary shaft and lubricated with the oil, the compression unit being configured to compress refrigerant and discharge the compressed refrigerant in a direction away from the discharge part;

a muffler coupled to the compression unit and configured to guide the compressed refrigerant to the discharge part;

a separator coupled to at least one of the rotor or the rotary shaft and configured to separate oil from the compressed refrigerant guided to the discharge part;

a coupling unit that fixes the separator to the at least one of the rotor or the rotary shaft; and a balancer disposed inside the separator and coupled to the drive unit, the balancer being configured to compensate vibration or eccentric force generated from the compression unit, wherein the separator comprises:

a coupling body coupled to at least one of the rotor or the rotary shaft, and a separation body that extends from an outer circumferential surface of the coupling body toward the discharge part, wherein the balancer is received in the separation body, wherein the coupling unit comprises a fastening member that passes through at least one of the balancer or the coupling body and that is coupled to the at least one of the rotor or the rotary shaft through the at least one of the balancer or the coupling body, and wherein the fastening member comprises a plurality of fastening members comprising:

at least one fastening member that passes through the coupling body and that is coupled to the rotor through only the coupling body, and one or more fastening members that pass through both of the coupling body and the balancer and that are coupled to the rotor through both of the coupling body and the balancer.

2. The compressor according to claim 1, wherein the one or more fastening members pass through both of the coupling body and the rotor and couple the coupling body to the rotor.

3. The compressor according to claim 2, wherein the one or more fastening members comprise:

a first body seated on the coupling body;

an extension body that extends from the first body and that passes through the rotor; and a second body that extends from the extension body or that is coupled to the extension body, the second body being exposed outside the rotor.

4. The compressor according to claim 1, wherein the one or more fastening members pass through all of the balancer, the coupling body, and the rotor.

5. The compressor according to claim 4, wherein the one or more fastening members comprise:

a first body seated on an exposed surface of the balancer;

an extension body that extends from the first body or that is coupled to the first body, the extension body passing through the balancer, the coupling body, and the rotor; and a second body that extends from the extension body or that is coupled to the extension body, the second body being exposed outside the rotor.

6. The compressor according to claim 1, wherein the separator is integrally formed with the balancer.

7. The compressor according to claim 1, wherein the separator defines:

a discharge hole that passes through an outer circumferential surface of the separation body and that is configured to discharge oil in the separator.

8. The compressor according to claim 7, wherein the discharge hole is defined at a region at which the separation body is in contact with the coupling body.

9. The compressor according to claim 7, wherein the discharge hole is spaced apart by a predetermined distance from the coupling body in a direction to the discharge part.

10. The compressor according to claim 7, wherein the discharge hole is spaced apart from the balancer.

11. The compressor according to claim 1, wherein the separator has a cylindrical shape and defines an inner space configured to receive refrigerant containing oil, and wherein the discharge part has a first end inserted in the inner space of the separator and a second end disposed outside the case.

* * * * *